United States Patent [19]

Hepperle

[11] 3,967,469

[45] July 6, 1976

[54] WARP KNITTING MACHINE WITH IMPROVED THREAD FEEDING APPARATUS

[75] Inventor: Phillip Hepperle, Jugesheim, Germany

[73] Assignee: Karl Mayer Textilmaschinenfabrik GmbH, Obertshausen, Germany

[22] Filed: July 25, 1975

[21] Appl. No.: 599,310

[30] Foreign Application Priority Data

July 29, 1974 Germany ..... 2436452

[52] U.S. Cl. ..... 66/84 A

[51] Int. Cl.[2] ..... D04B 23/06; D04B 23/08; D04B 23/10; D04B 23/12

[58] Field of Search ..... 66/84 A, 125, 83, 85 A; 28/1 CL

[56] References Cited

UNITED STATES PATENTS

| | | | |
|---|---|---|---|
| 3,523,432 | 8/1970 | Vajda et al. | 66/84 A |
| 3,703,818 | 11/1972 | Umeda et al. | 66/84 A |
| 3,771,330 | 11/1973 | Carman | 66/84 A |
| 3,797,278 | 3/1974 | Kohl | 66/84 A |
| 3,911,698 | 10/1975 | Walford | 66/84 A |

*Primary Examiner*—Ronald Feldbaum
*Attorney, Agent, or Firm*—Behr & Woodbridge

[57] ABSTRACT

A warp knitting machine includes an improved thread feeding apparatus. The thread feeding apparatus includes a source of weft threads which are drawn through a plurality of flexible tubes and are connected in groups to a plurality of slideable blocks. The blocks are adapted to move sequentially in synchronization with a conventional weft thread transfer chain having standard weft thread pick-up clamps attached thereto. The invention allows a large number of threads to be fed to a conventional warp knitting machine at one time.

4 Claims, 9 Drawing Figures

WARP KNITTING MACHINE WITH IMPROVED THREAD FEEDING APPARATUS

BACKGROUND OF THE INVENTION

1. Field of the Invention

This invention relates to an improved thread feeding apparatus adapted for use with a conventional warp knitting machine.

2. Description of the Prior Art

There are several different types of well known devices for transferring thread from a spool to a warp knitting machine. Almost all of the devices incorporate a transfer chain which draws the warp thread from a spool through some sort of guide. The guides or feeding mechanisms differ from machine to machine. According to one known device, a plurality of levers are used to guide the thread from the spools to the transfer chain. The curvature of the path of the levers is chosen so that the arcs described by the levers intersect the chain at a predetermined pick up point. At that point, a clamp on the chain picks up the thread and drags it across the length of the warp knitting machine. The lever is adapted to pivot and follow the movement of the withdrawn thread. With the thread fully extended, a mechanism on the warp knitting machine picks up the thread at a point near the lever and cuts it and subsequentially feeds it into the warp knitting machine. Such a device is described in German Pat. No. 2,034,283 in FIG. 3 thereof. This technique is limited by the fact that it is undesirable to have a large number of levers moving in a confined space. There are also inertial and frictional problems associated with the devices.

Another technique known in the prior art is the figure 8 chain feeding mechanism. This device was an improvement over the lever type mechanism; however, it still lacks the ability to handle a large number of weft threads efficiently. In view of the above, it was therefore desirable to provide a new apparatus of relatively simple construction which would allow a substantially large number of weft threads to be handled at one time.

SUMMARY OF THE INVENTION

According to the present invention, the problem of the prior art is solved by handling the weft threads in groups. The weft thread is fed from a plurality of spools through a plurality of flexible tubes which form thread guides. The thread guides are connected in groups to a plurality of blocks which are adapted to move in parallel orientation one to the other. Therefore, each block includes a group of thread guides connected thereto. The blocks are adapted to be presented sequentially to the carrier or thread transfer chain. After the block delivers the thread from the thread guide in a predetermined group, the block then is moved out of position and another block takes its previous place. The blocks are driven by levers which are, in turn, driven by a cam through a cam follower.

Part of the invention lies in the basic findings that it is not necessary that the paths of all the thread guides intersect at a particular point. Since the thread guides are provided on the guide element or block in groups, it is possible to provide a substantially large number of thread guides in close proximity to each other. The provision of thread guide groups in a mutually parallel relationship is very economical and structurally uncomplicated.

According to the preferred embodiment of the invention, the blocks are disposed to slide within the confines of a guide or holder. The holder is structured so that the blocks slide in different levels or planes parallel to one another. The blocks are thus located in separate planes vertically one above the other but there may be a small offset. The flexible tubing may pass through the blocks and may be bent upwardly or downwardly in order to discharge all of the threads at substantially the same vertical level. In this manner, it is possible to sequentially present a large number of threads to the transfer chain of a warp knitting machine. These and other features of the invention can be seen from the following drawings.

DETAILED DESCRIPTION OF THE INVENTION

During the course of this description, like numbers will be used to indicate like elements according to the different drawings.

Figure 1:
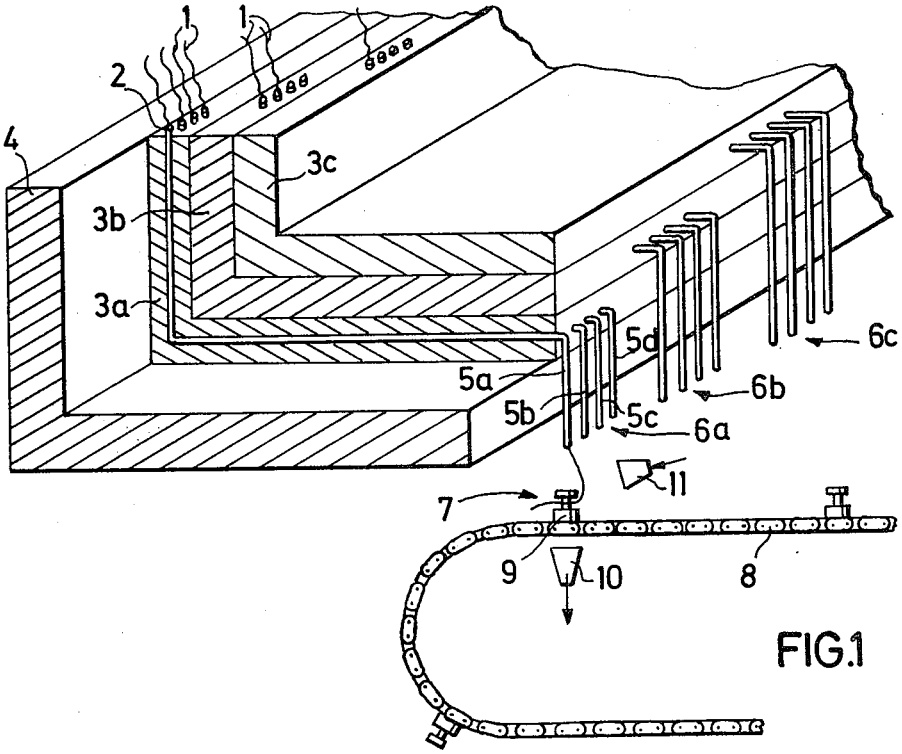
FIG. 1 is a partial cut-away view of a thread feeding apparatus shown in conjunction with a conventional transfer chain according to a general embodiment of the present invention.
Figure 2:
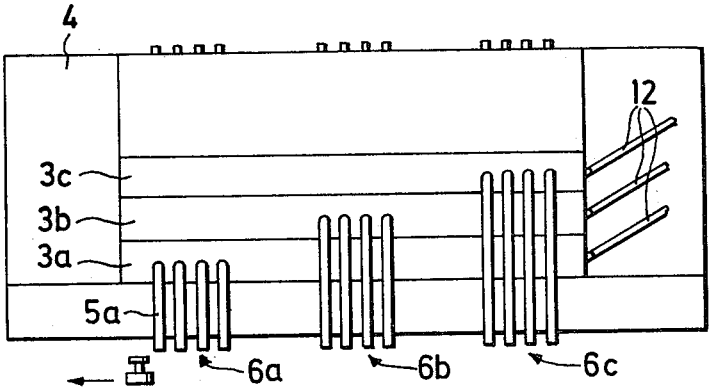
FIG. 2 is a schematic representation of one instance in the thread feeding cycle of the embodiment of FIG. 1.
Figure 3:
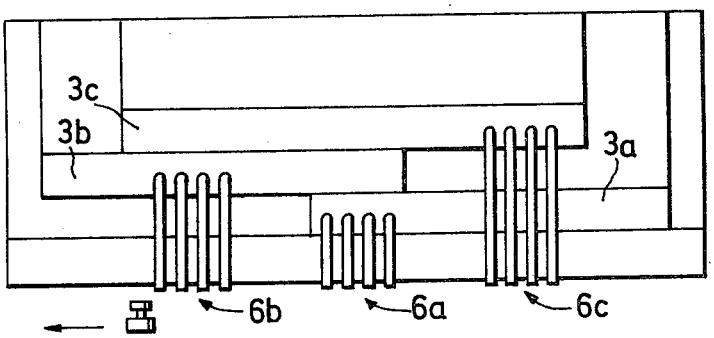
FIG. 3 is a schematic representation of a subsequent instance in the thread feeding cycle illustrated in FIG. 2.

One general embodiment of the present invention is illustrated in FIGS. 1 – 3. According to FIG. 1, three mutually parallel and slideably contacting blocks 3A, 3B and 3C lie in the channel of carrier 4. Each block 3 includes four thread guides in a group. The thread guides are labeled 5A, 5B, 5C and 5D. Therefore, each of the mutually slideably blocks 3A, 3B and 3C contain respectively groups 6A, 6B and 6C of the four thread guide tubes 5A, 5B, 5C, and 5D.

Threads 1 are drawn in a conventional manner from a pluraity of spools (not shown in the drawings) and enter opening 2 in the thread guides. The threads 1 then pass through sliding blocks 3A, 3B and 3C and emerge through the tubular exit guides 5A, 5B, 5C and 5D in groups 6A, 6B and 6C. The tubular exit guides 5 are adapted to be picked up by pick-up clamps 9 at a pick up point 7. The blocks 3A, 3B and 3C sequentially move into and out of the pick up location 7. A suction jet 10 and a blower jet 11 are optionally located proximate to pick up point 9. The suction jet 10 and blower jet 11 help to orient the thread 1 and direct it by means of the air stream passing therebetween into the pick-up clamp 9. A schematically illustrated guiding means 12 is associated with the thread guide groups 6 on the blocks 3 so that the threads 1 exiting from thread guide tubes 5 can transfer to the transfer clamp 9 on the transfer chain 8 in a manner which does not interfer with any of the other thread guides. Immediately following the transfer of the thread 1 from thread exit guide 5A, the thread from the next following thread exit guide 5B is placed in proximate juxtaposition with the next take up clamp 9 on chain 8 until in sequence all of the threads in group 6A have been picked up by the appropriate pick up clamp 9. Thereafter, the group 6B moves into the position shown in FIG. 3 and, after all of the threads of group 6B have been taken up, group 6C moves into position in proper juxtaposition in chain 8. Of course, when group 6C moves into position, group 6B moves away. The exit points of the thread exit guide tubes 5A, 5B, 5C and 5D, as shown in FIGS. 2 and 3, lie in a relatively flat, horizontal plane. In contrast to this, the individual tubes 5 comprising groups 6A, 6B and 6C are somewhat displaced relative to one another in a vertical plane so that they may run past each other.

After the thread 1 has been placed in the carrier clamp 9, the weft chain 8 pulls this thread the full length of the weft across the machine. At the same time, the groups 6 move backwards towards the machine and presents the thread to the warp knitting machine in a conventional manner. The thread is thereafter cut at the end closest to the exit tubes 5 and are inserted into the warp knitting machine in a manner known to those of ordinary skill in the art.

According to the general embodiment described in FIGS. 1 – 3, it will be appreciated that the blocks 3A, 3B and 3C have a right angle bend therein. Additionally, the exit tubes 5 are bent at right angles with respect to the face of the blocks from which they emerge. While this embodiment is desirable for several applications, it will be appreciated that the right angle bend within the block and the bend of the exit tube 5 is not necessary in all applications. Additionally, the embodiment of FIGS. 1 – 3 shows the use of three groups 6 each having four exit tubes 5. It will be appreciated from the rest of the description of the invention that more groups of thread guides may be used and that more thread guides can be incorporated into any individual group. The flexible thread guides help to keep the threads separated and thereby help to reduce tangling and friction.

Figure 4:
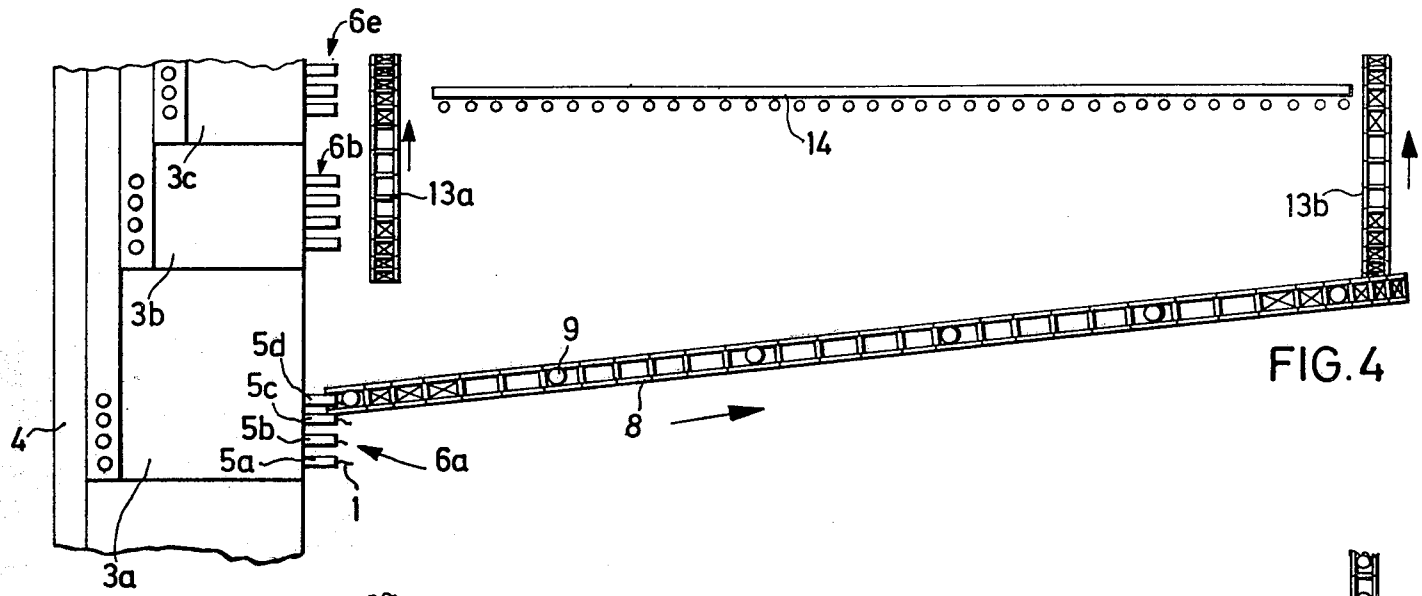
FIG. 4 is a top plan view of the preferred embodiment of the present invention shown during a predetermined particular sequence of its machine operation.
Figure 5:
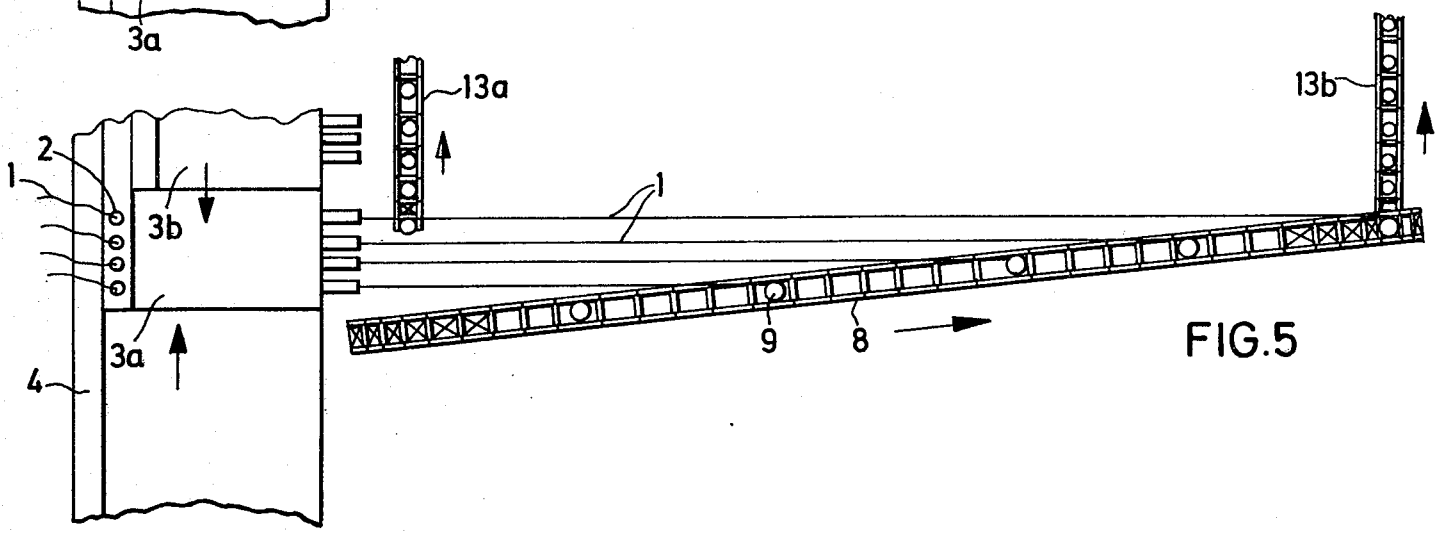
FIG. 5 is a top plan view of the preferred embodiment shown at another point in its sequence.

A preferred embodiment of the present invention is illustrated in FIGS. 4 – 9. FIG. 4 is a plan view of a preferred embodiment of the present invention incorporating the general principals disclosed in FIGS. 1 –3. In FIG. 4, the block 3A is shown in its end position of travel. A guides means 4 controls the lateral movement of block 3A. A steering means 12 is adapted to contact block 3A and move it back and forth within the confines of the guide means 4. The group 6A containing thread guide tubes 5A is shown at the point where clamps 9 on chain 8 are about to pick off the threads 1 from the exit tubes 5. In a manner that is well known to the prior art, the transfer chain 8 is shown slanted at a slight angle with respect to the warp knitting machine and the thread transfer means. According to the preferred embodiment, the take up order within group 6A is 5D, then 5C, then 5B, then 5A. The thread 1 emerges from tube guide 5 over chain 8 and according to methods well known to those of ordinary skill in the art, a thread clamp 9 picks thread 1 away from guide 5D by neumatic or mechanical means. The continuously revolving chain 8 now takes this thread end by means of clamp 9 in the direction shown by the arrow and during this time the block 3A moves slightly backward in the direction of the arrow shown in FIG. 5 so that the tube 5C now has its thread end 1 lying near chain 8. The next clamp 9 on chain 8 will, in a similar fashion, pick up the thread 1 emerging from tube 5C and move it in the direction of the arrow of chain 8. Accordingly, the procedure is then repeated with respect to tubes 5B and 5A respectively. According to FIG. 5, the chain 8 now draws the threads 1 from the thread tubes 5 of group 6A in the direction of arrow 8 to the other end of the machine in a conventional manner. In the meantime, the block 3A moves in the direction shown by the arrow until such time as the threads are taken up by the weft insertion chains 13A and 13B. Again, in a conventional manner, the threads 1 from chain 8 are cut off in the proximity of the guide tubes 5. The weft thread chain 13A and 13B then transfer the thread 1 to the needle bed 14 where they arrive at the stitch building position. As stated previously, the transfer of a weft thread 1 to a transfer chain 8 and from there to a pair of weft chains 13A and 13B is totally conventional and well known in the prior art. The important aspect of the present invention, however, lies in the thread feeding means which feed the threads 1 to the transfer chain 8. Note that as the chain 8 draws the thread across the width of the warp knitting machine, the group 6A and therefore the blocks 3A, moves along with the threads so that the threads are essentially presented in a parallel fashion to inserting chains 13A and 13B.

Figure 6:
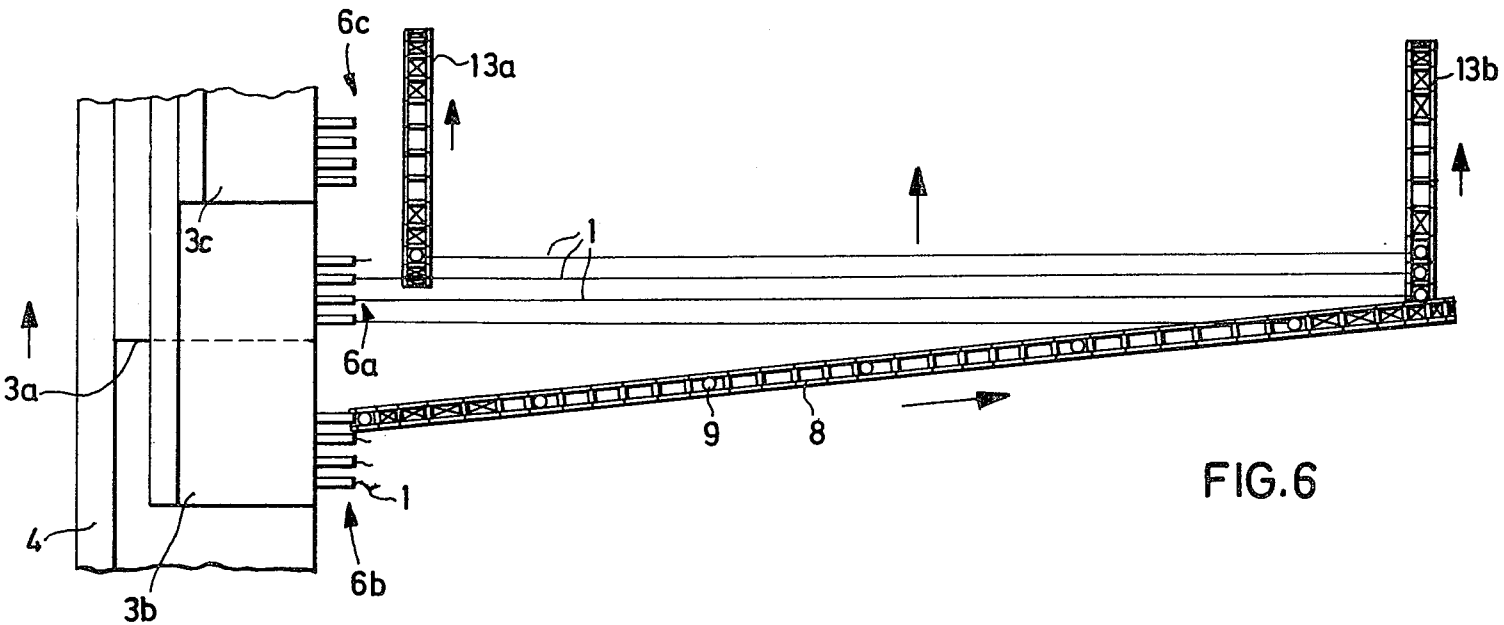
FIG. 6 is another top plan view of the preferred embodiment showing the machine operation at still another instance of its operation.

After the thread guides 5 of group 6A have given up their threads 1 to chain 8 and then proceed to retreat in the direction shown, the next block 3B is then brought into starting position at pick up point 7 as shown in FIG. 6. Thereafter, group 6B gives up its thread 1 to chain 8 in a manner similar to that described with reference to group 6A. Thereafter, the block 3B retreats and, after transfer, the threads 1 are cut off in the proximity of tubes 5 and the transfer chain gives the threads 1 over to the weft chains 13A and 13B to be transferred to the needle bed 14. In a completely analogous manner, the block 3C carrying tube group 6C transfers its threads to the chain 8 and those, in turn, are presented to the needle bed 14.

Figure 7:
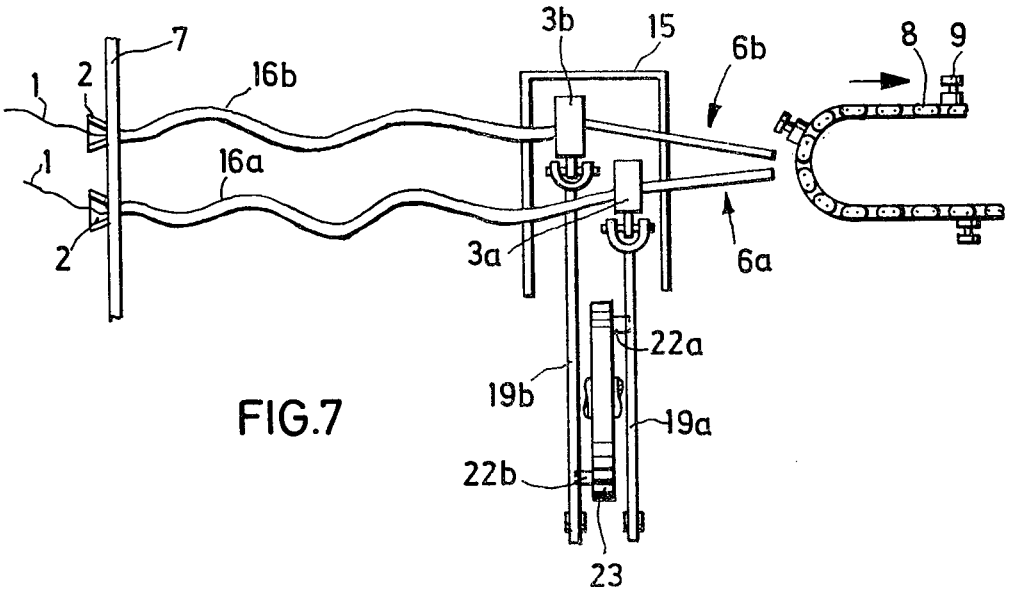
FIG. 7 is an end view of the preferred embodiment illustrating in detail the block driving mechanism.

The guiding and driving mechanism of the invention is shown in an end view in FIG. 7. According to this view, the blocks 3A and 3B are set into the receiving guide 15 of the principal body of the machine and perpendicular to the needle bed 14 in a slideable manner. The blocks 3A and 3B are driven by levers 19A and 19B. Each block 3A and 3B has attached thereto a plurality of flexible tubes or hoses 16A or 16B which are connected through a plate 17. Each hose 16A and 16B is attached to a thread in that opening tube. The threads 1 comes from the spools in a conventional manner and, therefore, the spool mechanism is not illustrated in the drawings. The threads pass through the openings 2 in the individual hoses 16A and 16B and are thus led via blocks 3A and 3B into the tubes of the tube groups 6A and 6B. The transfer of the threads 1 from the tubes 5 of groups 6A and 6B and onto the transfer chain 8 is achieved in the manner described with reference to FIGS. 1 – 6.

Figure 8:
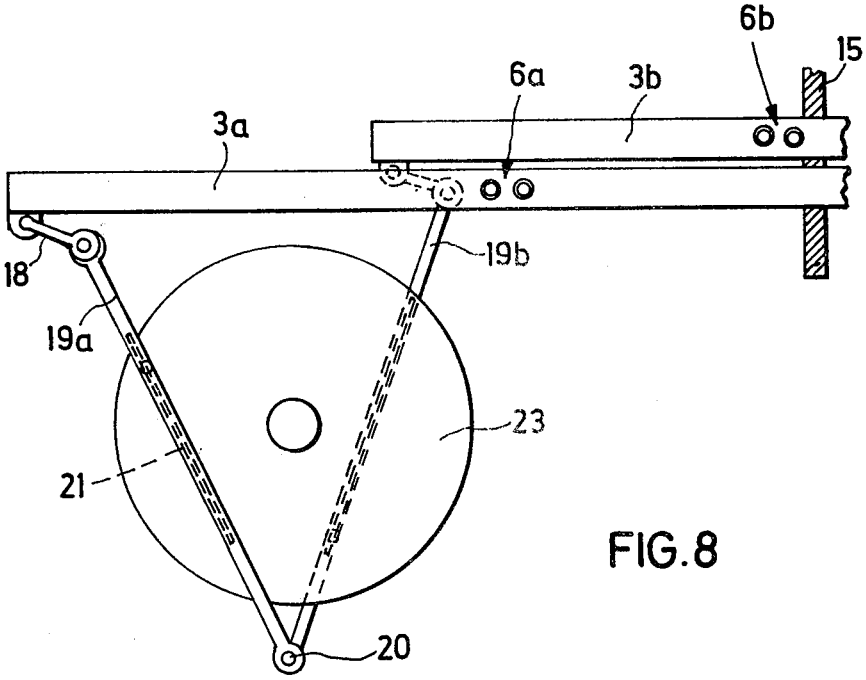
FIG. 8 is a side view of the preferred embodiment illustrated in FIG. 7.

FIG. 8 describes the manner and apparatus used to slideably drive blocks 3A and 3B. Blocks 3A and 3B are slideably mounted in holder or guide 15. As described previously, the blocks 3A and 3B are adapted to carry tube exit 6A and 6B. According to FIG. 8, the left hand side of blocks 3A and 3B are connected via links or levers 18 to the previously mentioned drive levers 19A and 19B. Levers 19A and 19B are partially rotatable about axis 20. Drive wheel 23 includes a longitudinal groove on one or both sides thereof adapted to engage nipples 22A and 22B attached respectively to drive levers 19A and 19B. In this manner, the drive wheel 23 acts as a cam and nipples 22A and 22B act as cam followers when they ride in groove 21. The longitudinal movement of the blocks 3A and 3B within guide holding mechanism 15 is achieved by rotating drive wheel 23. Rotation of the drive wheel 23 causes the cam followers 22A and 22B to move the drive levers 19A and 19B backward and forward respectively. The backward and forward movement of levers 19A and 19B in turn causes links 18 to drive the left end of blocks 3A and 3B into and out of the guide or holding mechanism 15.

Figure 9:
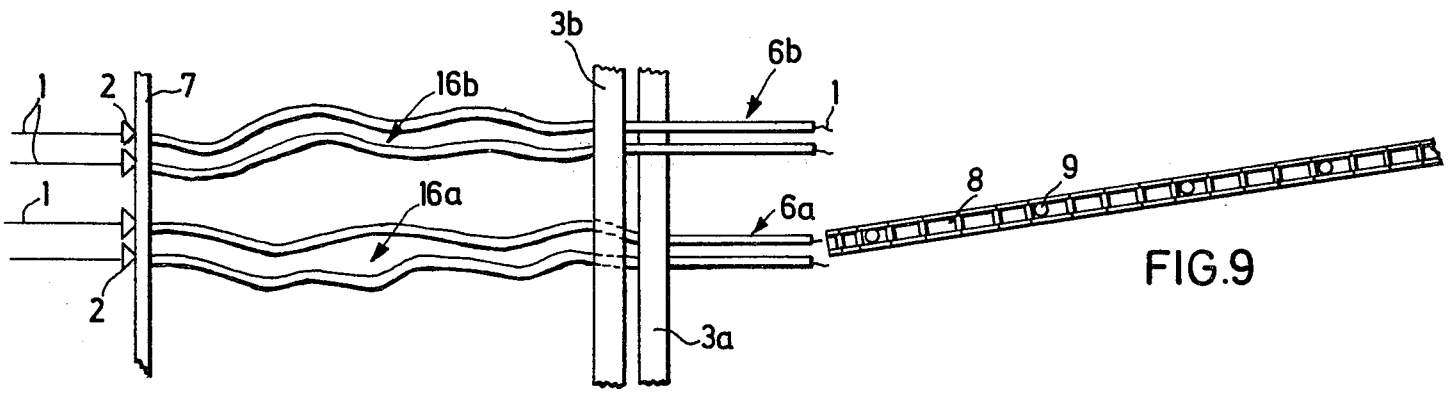
FIG. 9 is another top plan view of the preferred embodiment of the present invention.

A generalized top plan view of the thread feeding mechanism can be seen in FIG. 9. It should be noted that this preferred embodiment of the invention does not include a right angle change of thread direction either within the blocks 3 themselves or at the discharge tube end. The path of the thread 1 through the blocks 3 and the discharge tubes 5 or 6 is dictated largely by the preference of the manufacturer. Note, according to FIG. 7, that the exit tube 6A and 6B are canted upward or downward respectively so that the thread ends 1, whether they come from block 3A or 3B, are discharged at approximately the same vertical height. Also with regard to FIG. 7, it is seen that the blocks 3A and 3B move in different planes one above the other. In other words, block 3A moves in a plane that is below the plane of block 3B. While the blocks 3A and 3B move in different planes, the blocks themselves are not necessarily located directly above one another. As seen in the figure, the block 3B is offset slightly further away from chain 8 than is block 3A.

The invention has been completely described but it will be apparent to those of ordinary skill in the art that certain changes and modifications can be made thereto. As stated previously, the path of the thread 1 through the blocks 3 and the exit tubes 5 or 6 can be straight or may take right angle turns. A straight path, such as that disclosed in the preferred embodiment of FIGS. 4 – 9, may be preferable since it eliminates the unnecessary thread friction associated with going around corners.

While the invention has been particularly shown and described with reference to the preferred embodiment thereof, it will be understood by those skilled in the art that various changes in form and detail may be made therein without departing from the spirit and scope of the invention.

What is claimed is:

1. A warp knitting machine having an improved thread feeding apparatus, said machine comprising:

a source of threads;

a thread transfer chain, said chain having thread pick-up clamps attached thereto;

a thread feeding means for transferring the threads to the pick-up clamps of the thread transfer chain, said thread feeding means including a plurality of thread guides connected together in groups, said groups being adapted to move in different planes parallel to one another;

a driving means for moving said groups of guides past each other without mutual interference; and, a thread inserter apparatus oriented to pick up one end of a weft thread from the transfer chain and the other end from the thread feeding means and adapted to present said thread to said knitting machine.

2. The machine of claim 1 wherein said groups of thread guides are attached to mutually parallel and mutually slideable blocks.

3. The machine of claim 1 wherein the thread guides comprise flexible tubing.

4. The machine of claim 2 wherein the thread guides comprise flexible tubing.

* * * * *